US006824625B2

(12) United States Patent
Fukuda et al.

(10) Patent No.: US 6,824,625 B2
(45) Date of Patent: Nov. 30, 2004

(54) MAGNETOSTRICTION CONTROL ALLOY SHEET, A PART OF A BRAUN TUBE, AND A MANUFACTURING METHOD FOR A MAGNETOSTRICTION CONTROL ALLOY SHEET

(75) Inventors: Norio Fukuda, Iwata (JP); Shinya Nakamura, Iwata (JP); Hiroyuki Yamada, Iwata (JP); Akira Makita, Tokyo (JP); Tsutomu Hatano, Tokyo (JP); Nobuaki Kanayama, Tokyo (JP); Takahito Aoki, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 09/909,396

(22) Filed: Jul. 19, 2001

(65) Prior Publication Data

US 2002/0033207 A1 Mar. 21, 2002

(30) Foreign Application Priority Data

Jul. 24, 2000 (JP) ..... 2000-222335

(51) Int. Cl.[7] ..... H01F 1/16; H01J 29/80; H01J 29/70

(52) U.S. Cl. ..... 148/311; 148/310; 420/95; 420/97; 420/112; 313/402; 313/408; 313/409; 313/420; 313/421

(58) Field of Search ..... 148/310, 311; 420/95, 97, 112; 313/402, 408, 409, 420, 421

(56) References Cited

U.S. PATENT DOCUMENTS 4,943,883 A * 7/1990 Sano et al. ..... 360/126
5,028,280 A * 7/1991 Ihara et al. ..... 148/306
5,252,148 A * 10/1993 Shigeta et al. ..... 148/307
5,276,505 A * 1/1994 Jeong ..... 348/649
5,443,664 A * 8/1995 Nakajima et al. ..... 148/307
5,643,697 A 7/1997 Baudry et al.
5,873,955 A * 2/1999 Kirino et al. ..... 148/306

FOREIGN PATENT DOCUMENTS

| | | |
|---|---|---|
| JP | 61-064853 | 4/1986 |
| JP | 61-186452 | 8/1986 |
| JP | 62-112759 | 5/1987 |
| JP | 62-174353 | 7/1987 |
| JP | 01-204333 | 8/1989 |
| JP | 04-228545 | 8/1992 |
| JP | 06-264140 | 9/1994 |
| JP | 07-166298 | 6/1995 |

OTHER PUBLICATIONS

Office Action/Notice of Reasons for Rejection, dated Mar. 11, 2003, Mailing No. 080818, from Japanese Patent Office in Application No. 2000–222335 (related application) (English translation).

* cited by examiner

*Primary Examiner*—John P. Sheehan
(74) *Attorney, Agent, or Firm*—Pillsbury Winthrop LLP

(57) ABSTRACT

The invention relates to a magnetostriction control alloy sheet advantageously used as a high resolution shadow mask having a low coefficient of thermal expansion, superior magnetic properties and a high Young's modulus after a blackening process, a manufacturing process for the same, and a part for a color Braun tube such as a shadow mask. The magnetostriction control alloy sheet comprises C at 0.01 wt. % or less, Ni at 30 to 36 wt. %, Co at 1 to 5.0 wt. %, and Cr at 0.1 to 2 wt. %, the remainder Fe and unavoidable impurities, and having a magnetostriction λ after the softening and annealing of ($-15\times10^{-6}$) to ($25\times10^{-6}$).

8 Claims, 1 Drawing Sheet

MAGNETOSTRICTION CONTROL ALLOY SHEET, A PART OF A BRAUN TUBE, AND A MANUFACTURING METHOD FOR A MAGNETOSTRICTION CONTROL ALLOY SHEET

BACKGROUND OF THE INVENTION

1. Field of the Invention

The present invention relates to a magnetostriction control alloy sheet having a low thermal expansion and a manufacturing method for the same, and in particular relates to a magnetostriction control alloy sheet advantageous as a shadow mask used in a CRT (cathode-ray tube) and a method of manufacturing for the same.

The present Specification is based on a Japanese patent application (patent application 2000-222335), the content of which is incorporated as a part of the present specification by reference.

2. Description of Related Art

Generally, in order to manufacture a shadow mask used for example in the display for a PC (personal computer), first, an alloy sheet is perforated by a photoetching process, and a plurality of apertures are formed that allow passage of an electron beam. Next, the obtained flat mask is softened and annealed, and subsequently, the softened and annealed flat mask is pressed by press formation into a shape that conforms to the shape of the CRT. Finally, the upper surface is blackened.

Specifically, in the softening and annealing process, softening and annealing is carrying out having the object to be softened at about 750 to 1000° C. followed by carrying out press formation. In the typical shadow mask, a distorsion of several percent is imparted by this press formation. Then, after press formation, a blackening process is carried out at about 500 to 700° C. in an oxidizing atmosphere.

In this manner, the alloy sheet is formed into a shadow mask through the sequence of etching and softening, annealing, press formation, and blackening processes, and then mounted in a CRT.

As an alloy used for the material of the shadow mask, soft steel sheets such as low carbon rimmed steel, low carbon aluminum killed steel, or the like were once used, but because these materials have a high coefficient of thermal expansion, they exhibit a large amount of doming, which is to say that the doming characteristics deteriorate. Doming is a phenomenon in which the shadow mask is heated and thermal expansion occurs due to the radiation of the electron beam that does not pass through the apertures of the shadow mask. Consequently, the electron beam that passes through the apertures of the shadow mask does not land on the determined position on the phosphorescent surface. In order to prevent this doming phenomenon, conventionally an Fe—Ni invar (Ni 36%, remainder Fe) has been used.

In recent years, both the definition and flattening of the displays have progressed, and thus the plane strength must be further increased.

The plane strength of the shadow mask mounted in the CRT is formulated by the plane buckling strength of the sheet. This plane buckling strength is proportional to the square of the sheet thickness and the value of the Young's modulus (E). Therefore, generally in the case of the same sheet thickness, using a material having a high Young's modulus can increase the plane strength.

This means that in a material for a shadow mask, conventionally, a low coefficient of thermal expansion is required, and at the same time, a high Young's modulus is required in order to further improve the plane strength.

However, in shadow masks that use current invar material, the Young's modulus is still insufficiently high, and this is a problem for the plane strength. Therefore, a material for a shadow mask is required that maintains the low thermal expansion properties of an invar material and at the same time has a high Young's modulus in the state following the final blackening process.

In contrast, in the case of using a general Fe—Ni alloy in the shadow mask, the electron beam is deflected by the stray magnetic fields present in the external environment of the color Braun tube, and thereby "color deviation" occurs due to the failure of the electron beam to land on the predetermined pixel, which is of concern in terms of image quality problems.

Furthermore, the increasingly high density of the graphic displays and the like in color displays is progressing, and together with this, there is a trend for the electron beam density to increase, and thus the average current is increasing. Thus, due to the current produced when the electron beam passes through the apertures in the shadow mask, "color deviation" that occurs due to the shadow mask itself becoming magnetized is also a problem in terms of the image quality.

Therefore, as a material for a shadow mask, in order to prevent the influence of magnetization due to the terrestrial magnetism and the electron beam, the advantageous magnetic properties of high permeability and low coercive force are also required.

In consideration of the problems described above, it is an object of the present invention to provide an advantageous magnetostriction control alloy sheet, a manufacturing method for the same, and a part for a color Braun tube such as a shadow mask that has a low coefficient of thermal expansion, superior magnetic properties, and at the same time has a high Young's modulus even after a blackening process.

SUMMARY OF THE INVENTION

The magnetostriction control alloy sheet according to the present invention is an alloy plate used in a part for a color Braun tube such as a shadow mask, and is characterized in that the magnetostriction $\lambda$ after softening and annealing is between $(-15\times10^{-6})$ and $(25\times10^{-6})$.

The magnetostriction control alloy sheet according to the present invention preferably incorporates C at 0.01 wt. % or less, Ni at 30 to 36 wt. %, Co at 1 to 5.0 wt. %, and Cr at 0.1 to 2 wt. %, and also incorporates Si at 0.001 to 0.10 wt. % and/or Mn at 0.001 to 1.0 wt. %, the remainder comprising Fe and unavoidable impurities.

In addition, the parts for a color Braun tube such as the shadow mask according to the present invention are characterized in using the above-described magnetostriction control alloy sheet as a material. Moreover, in addition to use as a shadow mask, another example of a part in a color Braun tube for which the present invention can be used is an inner seal or the like.

A manufacturing method for the magnetostriction control alloy sheet according to the present invention is characterized that after the Ni—Fe—Co alloy that incorporates C at 0.01 wt. % or less, Ni at 30 to 36 wt. %, Co at 1 to 5.0 wt. %, and Cr at 0.1 to 2 wt. %, and also incorporates Si at 0.001 to 0.10 wt. % and/or Mn at 0.001 to 1.0 wt. %, the remainder comprising Fe and unavoidable impurities, undergoes final annealing, there is a temper rolling process having a reduction ratio of 10 to 40%.

In the present invention, the final annealing temperature is 800 to 1100° C. and the reduction ratio by cold rolling before this final annealing can be 50% or greater.

Moreover, in the present invention, the permeability denotes the maximum permeability. Therefore, both "permeability" and "magnetostriction" are absolute numbers.

In addition, the "softening and annealing" in the present invention denote softening and annealing carried out between the etching and press formation processes during the process in which the shadow mask is manufactured from an alloy sheet.

According to the present invention, due to restricting appropriately the composition and magnetostriction of the Ni—Fe alloy and the Ni—Fe—Co alloy, a magnetostriction control alloy sheet having a high Young's modulus and permeability and a superior plane strength is obtained. In addition, by appropriately restricting the reduction ratio of the temper rolling carried out after the final annealing, the magnetostriction is ($-15\times10^{-6}$) to ($+25\times10^{-6}$), and superior magnetic properties for the shadow mask are obtained even after the softening and annealing, press formation, and blackening processes, and at the same time, a high Young's modulus is maintained, and stable physical properties are exhibited.

DETAILED DESCRIPTION OF THE INVENTION

Embodiments of the Invention

Figure 1:
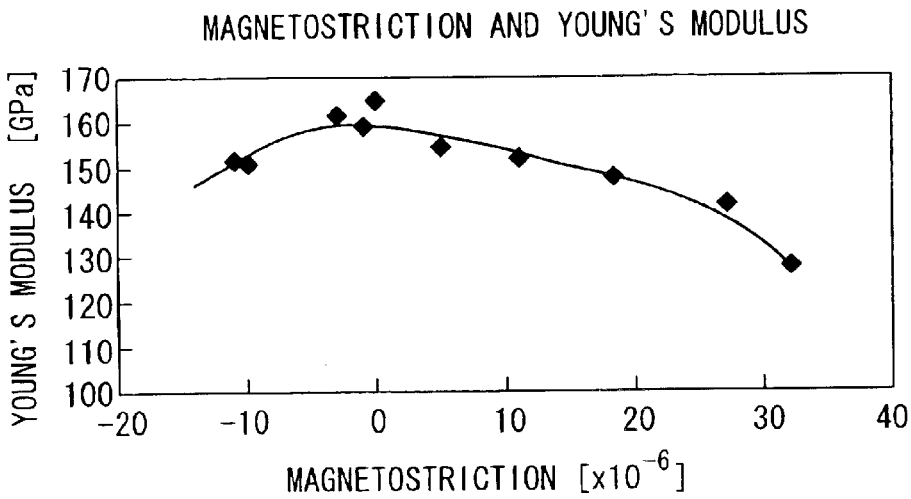
FIG. 1 is a graph showing the effect of the present invention, where the abscissa represents the magnetostriction and the ordinate represents the Young's modulus.

Below, the present invention will be explained in detail. As a result of thorough investigations by the authors of the present application, it was discovered that controlling the value of the magnetostriction λ is effective for restricting the coefficient of thermal expansion to about the same degree as invar, and at the same time making a material for a shadow mask that has superior magnetic properties and a high Young's modulus.

Specifically, the magnetostriction λ of a 36 Ni—Fe alloy used in current standard shadow masks made of invar material are influenced by their manufacturing history, and is about ($+26\times10^{-6}$) to ($+35\times10^{-6}$). In contrast, by adding predetermined amounts of Co and Cr to a Ni—Fe alloy and controlling the temper rolling after the final annealing, the inventors of the present application limited the magnetostriction λ to a lower value than the value of the magnetostriction λ of the current 36 Ni—Fe alloy, and made the range of the magnetostriction λ after softening and annealing ($-15\times10^{-6}$) to ($+25\times10^{-6}$). Thereby, it was discovered that while the thermal expansion characteristics were substantially the same as those of invar, the permeability and the Young's modulus could be improved.

Generally, a shadow mask is press formed after softening and annealing at a softening temperature of about 750 to 1000° C., as described above, and subsequently a blackening process is conducted in an oxidizing atmosphere at 500 to 700° C. At this time, with normal invar, the magnetic properties deteriorate due to a distorsion of several % being imparted by press formation, and there is insufficient restoration in the subsequent blackening process as well. Because of this, the magnetic properties greatly deteriorate in comparison to the properties at the completion of the softening and annealing. However, by limiting the magnetostriction after the softening and annealing to the values in the range of the present invention, the deterioration of the magnetic properties due to press formation becomes small, and thus the deterioration of magnetic properties after the press formation is reduced, and thereby the magnetic properties after the blackening process can be improved.

Below, the reasons for the incorporated elements of the magnetostriction control alloy sheet of the present invention and the numerical limitations of the magnetostriction λ will be explained.

By making C equal to or less than 0.01 wt. %, advantageous etchability can be obtained. If the incorporated C exceeds 0.01 wt. %, then the etchability of the magnetostriction control alloy is compromised. Therefore, C is equal to or less than 0.01 wt. %.

In addition, if the Ni content lies outside the range of 30 to 36 wt. %, the coefficient of thermal expansion becomes too large. Moreover, within this range, when the Ni concentration increases, the value of the magnetostriction becomes positive, and thus the Ni content is preferably low.

Co is added because it has the effect of making the magnetostriction λ negative. This effect is small when the Co content is less than 1.0 wt. %. However, when the Co content exceeds 5.0 wt. %, the coefficient of thermal expansion becomes too large. Therefore, the Co content is 1.0 to 5.0 wt. %.

Moreover, when the Ni+Co content is 34 to 39 wt. %, the coefficient of thermal expansion can be made smaller than that of the 36 Ni—Fe alloy.

Cr is also added because it also has the effect of making the value of the magnetostriction λ negative. This effect is small when the Cr content is less than 0.1 wt. %. However, when the Cr content exceeds 2.0 wt. %, the coefficient of thermal expansion becomes too large. Therefore, the Cr content is 0.1 to 2.0 wt. %.

Si and Mn are preferably added to the raw material as deoxidizers. In order to prevent damage to the etchability, when adding Si and Mn as deoxidizers, Si must be equal to or less than 0.10 wt. % and Mn must be equal to or less than 1.0 wt. %. However, in the case that the Si content is less than 0.001 wt. %, and the Mn content is less than 0.001 wt. %, a sufficient deoxidizing effect cannot be obtained. Therefore, at least either one of Si at 0.001 to 0.10 wt. % and/or Mn at 0.001 to 1.0 wt. % is preferably incorporated.

Figure 2:
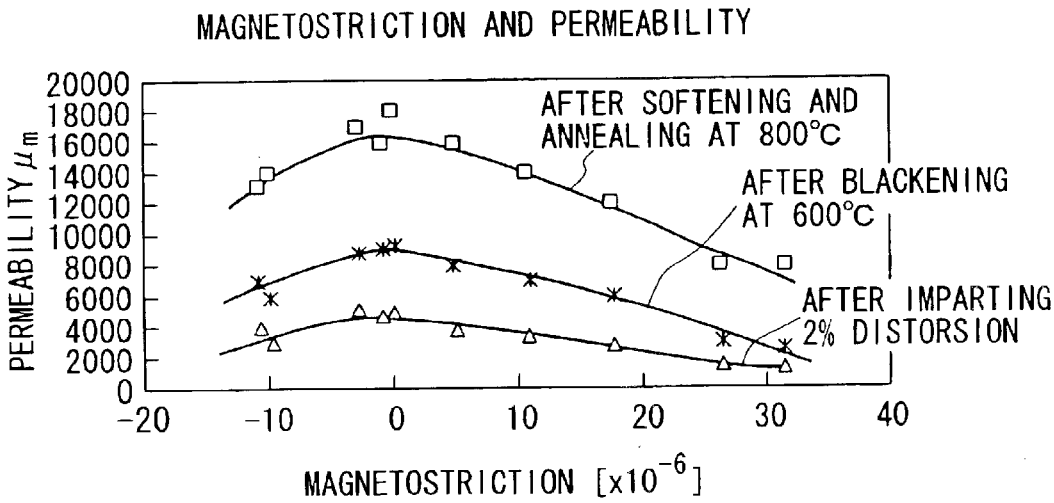
FIG. 2 is a graph showing the effect of the present invention, where the abscissa represents the magnetostriction and the ordinate represents the permeability.

In addition, as can be explained referring to FIG. 1 and FIG. 2, by restricting the magnetostriction λ after softening and annealing to a range of ($-15\times10^{-6}$) to ($+25\times10^{-6}$), a Young's modulus and permeability higher than invar can be obtained. FIG. 1 is a graph where the abscissa represents the magnetostriction λ and the ordinate represents the Young's modulus, showing the properties of the magnetostriction control alloy sheet. In addition, FIG. 2 is a graph where the abscissa represents the magnetostriction λ and the ordinate represents the permeability showing the properties of the magnetostriction control alloy sheet.

The measurement of the magnetostriction λ in FIG. 1 and FIG. 2 uses a commercially available distortion gauge, and measurement is carried out by converting the amount of distortion to an amount of electricity in a bridge circuit.

Specifically, after softening and annealing the alloy sheet having a thickness of 0.12 mm, samples were produced having a size that allows attachment of a distortion gauge, the magnetic dependence of the "distortion" is measured in a magnetic field of about 3200 A/m to 4000 A/m, and the magnetostriction is determined. The Young's modulus in FIG. 1 was determined by a resonance method. Specifically, a strong vibration was applied to a sample piece, and the coefficient of elasticity was calculated by measuring the resonance frequency. The permeability $\mu$m was found by carrying out a direct current magnetic property test according to JIS C 2531.

The Young's modulus in FIG. 1 and the permeability $\mu$m (after softening and annealing at 800° C.) in FIG. 2 are the result of carrying out softening and annealing of the alloy sheet at 800° C. and measuring the subsequent state.

In order to show the state after the softening and annealing process and before press formation in the manufacturing process for making the alloy sheet into a shadow mask, the softening and annealing at 800° C. was carried out as a process equivalent to the above-described softening and annealing process.

Moreover, since the temperature of the blackening process is generally 500 to 700° C. which is below the recrystallization temperature, the Young's modulus of the shadow mask mounted in the CRT is determined by the Young's modulus before the press formation and after softening and annealing. Therefore, the final Young's modulus can be determined by the Young's modulus after annealing at 800° C. described above.

The permeability $\mu_m$ (after imparting the distorsion of 2%) in FIG. 2 is the result of imparting the distorsion of 2% after the above-described softening and annealing at 800° C. and measuring the subsequent state.

In order to show the state after the press formation for making the alloy sheet into a shadow mask, a distorsion of 2% was imparted as a process equivalent to the above-described press formation process.

The permeability $\mu_m$(after blackening at 600° C.) in FIG. 2 is the result of blackening (600° C. in an oxidizing atmosphere) after above-described imparting of the distorsion of 2% and measuring the subsequent state.

In order to show the state after the blackening process for making the alloy sheet into a shadow mask, blackening (600° C. in an oxidizing atmosphere) was carried as a process equivalent to the above-described blackening process.

As shown in FIG. 1, when the magnetostriction $\lambda$ is in a range of $(-15\times10^{-6})$ to $(+25\times10^{-6})$, a Young's modulus can be obtained that is higher than the 128 GPa (refer to comparative example 1 explained below) of the invar alloy (36 Ni—Fe). In this range, the Young's modulus is about 147 to 165 GPa, and compared to the invar alloy, the strength increases about 15 to 29%. In addition, the Young's modulus becomes high as the magnetostriction $\lambda$ approaches zero.

In addition, as shown in FIG. 2, it is clear that the permeability also becomes high when the magnetostriction $\lambda$ is in the range of $(-15\times10^{-6})$ to $(+25\times10^{-6})$. As shown in FIG. 2, the permeability of the alloy sheet shows a value that is at one point higher due to the softening and annealing, but deteriorates due to the distorsion imparted by the press formation, while a part thereof is restored by the blackening process. In the relationship between the magnetostriction $\lambda$ and the permeability, the permeability shows a value that becomes higher as the magnetostriction $\lambda$ after softening and annealing approaches zero. The permeability after the blackening process becomes equal to or greater than 4000 when the magnetostriction $\lambda$ after softening and annealing is restricted to the range of $(-15\times10^{-6})$ to $(+25\times10^{-6})$, while the permeability of the invar alloy is 3000. In this manner, it is clear that by specifying the range of the magnetostriction $\lambda$, extremely superior magnetic properties are obtained.

Next, the manufacturing method of the magnetostriction control alloy sheet of the present invention will be explained. The magnetostriction control alloy sheet is manufactured by carrying out the processes of hot rolling, cold rolling (one time), annealing, cold rolling (two times), final annealing, and temper rolling.

At this time, as a method for making the magnetostriction $\lambda$ lower than that of current invar, as described above, adding Co or Cr as an alloy constituent is effective, but furthermore, a temper rolling reduction ratio equal to or less than 40% in the case of processing a thin sheet is preferable.

By adding this type of temper rolling process, the recrystallized grains become uniform due to the softening and annealing process after applying the etching process to the shadow mask shape. That is, even when the softening and annealing, press formation, and blackening processes are applied to the alloy sheet, the variance in the magnetostriction $\lambda$ decreases, its range becomes $(-15\times10^{-6})$ to $(+25\times10^{-6})$, and stable material properties are attained. When the temper rolling reduction ratio exceeds 40%, the grain size during recrystallization becomes small due to the annealing at 750 to 1000° C. and there is a tendency to form mixed grain sizes. Thus, the magnetostriction has a tendency to become negative more easily. This means that the values of the Young's modulus and the permeability become low.

In contrast, when the temper rolling reduction ratio is less than 10%, the recrystallized grain size during softening and annealing at 750 to 1000° C. becomes mixed easily, and the magnetostriction properties easily become uneven. In order to obtain an even crystal grain size by the softening and annealing of the alloy sheet, the temper rolling reduction ratio is preferably 10 to 30%.

In addition, the reduction ratio of the final cold roll is equal to or greater than 50%, and preferably by adjusting this to 70% or greater, the {100} degree of accumulation can be made 40 to 90%. Furthermore, by limiting the thermal processing conditions of the final annealing after the final cold roll, the crystal grain size number of the alloy sheet can be limited to 8 to 12. Because the shadow mask is etched, in order to improve the etchability, it is important that the crystal grain size and the crystal orientation of the material before etching be coordinated. The range of the preferable crystal grain size number is 9 to 12, and the preferable {100} degree of accumulation is 40 to 90%.

EXAMPLES

Below, examples of the present invention will compared to comparative examples that depart from the ranges of the present invention, and the effects produced thereby will be explained.

A Ni—Fe—Co alloy that is the constituent shown in Table 1 is melted by vacuum tempering within a temperature range of 1200 to 1350° C. the slab is heated treated at 1000 to 1250° C. and hot rolled to a thickness of 3.5 mm. Subsequently an alloy sheet having a thickness of 0.12 mm is manufactured by cold rolling, annealing, final cold rolling, final annealing, temper rolling, and a stress relief anneling process. In this manufacturing process, each of the final cold reduction ratios, the final annealing temperature, and the temper rolling reduction ratio are shown in FIG. 2.

TABLE 1

| | No. | Ni | Co | Cr | Si | C | Mn |
|---|---|---|---|---|---|---|---|
| Comparative examples | 1 | 36 | 0.03 | 0.01 | 0.03 | 0.005 | 0.28 |
| | 2 | 32 | 5 | 0.01 | 0.02 | 0.003 | 0.30 |
| | 3 | 33 | 3 | 2.2 | 0.01 | 0.003 | 0.30 |
| Examples | 4 | 32 | 4 | 1 | 0.01 | 0.005 | 0.29 |
| | 5 | 32 | 4 | 0.5 | 0.006 | 0.005 | 0.02 |
| | 6 | 32 | 4 | 0.5 | 0.03 | 0.004 | 0.30 |
| | 7 | 34 | 2 | 1 | 0.02 | 0.003 | 0.28 |
| | 8 | 33 | 3 | 1 | 0.01 | 0.005 | 0.27 |
| | 8a | 33 | 3 | 1 | 0.01 | 0.005 | 0.27 |
| | 8b | 33 | 3 | 1 | 0.01 | 0.005 | 0.27 |
| | 8c | 33 | 3 | 1 | 0.01 | 0.005 | 0.27 |
| | 9 | 33 | 3 | 0.5 | 0.01 | 0.003 | 0.30 |

of the other examples and the comparative examples were set to 20% or 25%.

Table 2 shows the crystal grain size of each of the obtained magnetostriction control alloy sheets is shown using the crystal grain size number, and also shows the {100} degree of accumulation.

The measurement of the grain size number was carried out according to the JIS G 055. In addition, the {100} degree of accumulation was calculated from the following equation 1 by an X-ray diffraction test.

$$\{100\}\text{ degree accumulation }(\%)=I(200)/\{I(111)+I(200)+I(220)+I(311)\} \quad \text{eq. 1}$$

where I (hkl) denotes the peak intensities of X-ray diffraction in the orientation of (hkl).

In addition, in order to evaluate the capacity of each of the obtained magnetostriction control alloy sheets as a shadow mask material, as processing equivalent to the shadow mask manufacturing processes, on each of the alloy sheets, softening and annealing (800° C.), imparting a distortion (2%), and blackening process (600° C. in an oxidizing atmosphere) were carried out. After each of these processes, the permeability was measured. In addition, the coefficient of thermal expansion (α), the magnetostriction (λ), and the Young's modulus (E) were measured after the softening and annealing (800° C.) described above. The results are shown in Table 3.

Moreover, because the numerical value of the coercive force (Hc) changes inversely to the change in direction of the permeability, for the magnetic properties, only the permeability ($\mu_m$) was measured and evaluated as a representative.

TABLE 2

| | No. | Final cold reduction (%) | Final annealing temperature (° C.) | Crystal grain size number | {100} degree of accumulation (%) | Temper rolling reduction (%) |
|---|---|---|---|---|---|---|
| Comparative examples | 1 | 70 | 900 | 11 | 70 | 25 |
| | 2 | 70 | 900 | 10.5 | 75 | 25 |
| | 3 | 80 | 900 | 10.5 | 70 | 20 |
| Examples | 4 | 85 | 900 | 10.5 | 80 | 20 |
| | 5 | 80 | 900 | 11 | 75 | 25 |
| | 6 | 80 | 900 | 11 | 75 | 25 |
| | 7 | 80 | 900 | 10.5 | 70 | 25 |
| | 8 | 85 | 900 | 10.5 | 70 | 20 |
| | 8a | 40 | 1050 | 8.5 | 40 | 20 |
| | 8b | 80 | 900 | 10.5 | 70 | 8 |
| | 8c | 80 | 900 | 11.0 | 70 | 60 |
| | 9 | 80 | 900 | 11.0 | 80 | 25 |

As shown in FIG. 2, in order to find the influence of the final cold rolling reduction ratio on the etchability and the influence of the temperature on the following final annealing in example 8a, the final cold rolling reduction ratio was 40%, and the final annealing temperature was 1050° C. Concerning the other examples and comparative examples, all have a final cold rolling reduction ratio of 70%, which is greater than 50% and final annealing temperature of 900° C.

In addition, in order to investigate the influence that the temper rolling reduction ratio after the final cold rolling has on the {100} degree of accumulation and the magnetostriction the temper rolling reduction ratio of the example 8b was set to 8%, and the temper rolling reduction ratio of example 8c was set to 60%. The temper rolling reduction ratios for all

TABLE 3

| | No. | Coefficient of thermal expansion α ($10^{-6}\cdot K^{-1}$) | Magnetostriction σ ($\times 10^{-6}$) | Young's modulus E (GPa) | Permeability $\mu m$ After annealing at 800° C. | After imparting 2% distortion | After blackening at 600° C. | Etchability |
|---|---|---|---|---|---|---|---|---|
| Comparative examples | 1 | 1.5 | 32 | 128 | 8000 | 1400 | 2800 | ○ |
| | 2 | 0.5 | 27 | 142 | 8000 | 1500 | 3000 | ○ |
| | 3 | 2.3 | −4 | 158 | 16000 | 5000 | 7500 | ○ |
| Examples | 4 | 1.4 | 11 | 152 | 14000 | 3500 | 7000 | ○ |
| | 5 | 0.9 | 18 | 147 | 12500 | 2900 | 5800 | ○ |
| | 6 | 0.9 | 18 | 148 | 12000 | 2800 | 6200 | ○ |
| | 7 | 1.5 | 5 | 155 | 16000 | 4000 | 8000 | ○ |
| | 8 | 1.2 | 0 | 165 | 18000 | 5000 | 9500 | ○ |
| | 8a | 1.3 | −1 | 160 | 16000 | 4800 | 9200 | Δ |
| | 8b | 1.2 | −11 | 152 | 13000 | 4000 | 7000 | ○ |

TABLE 3-continued

| No. | Coefficient of thermal expansion $\alpha$ ($10^{-6} \cdot K^{-1}$) | Magneto-striction $\sigma$ ($\times 10^{-6}$) | Young's modulus E (GPa) | Permeability $\mu m$ After annealing at 800° C. | After imparting 2% distortion | After blackening at 600° C. | Etcha-bility |
|---|---|---|---|---|---|---|---|
| 8c | 1.2 | −10 | 151 | 14000 | 3000 | 6000 | ○ |
| 9 | 1 | 3 | 162 | 17000 | 5200 | 9000 | ○ |

The method of measuring the magnetostriction, the Young's modulus, and permeability in Table 3 are each identical to the methods explained in the embodiments described above.

For the measurement of the coefficient of thermal expansion, according to the method of the EMAS-1005, after-softening and annealing an alloy sheet having a thickness of 0.12 mm, a sample for measurement having a length of 20 mm was cut off, and measured using a dilatometer consisting of a differential tranceducer.

In addition, the results of evaluating the etchability are also shown in Table 3. The evaluation of the etchability does not relate to etching speed or the like, but before the softening and annealing process described above, when the plurality of apertures are formed by the etching process, it is determined whether or not a roughened surface finish can be identified on the inner surface of the hole.

Referring to Table 1 through Table 3 described above, the results of the evaluations for each of the examples and comparative examples are described.

The Ni—Fe of comparative example 1 is a standard 36 Ni—Fe invar. Because the range of the magnetostriction of comparative example 1 exceeds the upper limit of the value defined by the present invention, the magnetic properties (permeability) and the Young's modulus are low.

The Ni—Fe—Co is comparative example 2 is a super invar material, and the coefficient of thermal expansion is lower than invar, the permeability is also at the level of the invar (comparative example 1), the Young's modulus is higher than invar, but in order to improve the flat plane strength, a higher Young's modulus is necessary.

Because the Cr content of the comparative example 3 is greater than the range of the present invention, the coefficient of thermal expansion is too high.

Because the constituents and the value of the magnetostriction of the Ni—Fe—Co alloy of examples 4 through 8 and 9 are within the range of the present invention, favorable magnetic properties are exhibited, and at the same time, a high Young's modulus is exhibited.

Because the constituents and the temper rolling reduction ratio of example 8a are within the range of the present invention, the magnetostriction properties are maintained and both Young's modulus and the permeability are high, but the crystal grain size number and the {100} degree of accumulation depart from the favorable range of present invention, and thus roughness occurs in the finish of the etching surface (inside the apertures), and there holes become what are termed rough holes, and the precision of the dimensions after the shadow mask processing is rather bad. However, from the point of utility, this does not comprise a significant hindrance.

Because example 8b was below the lower limit of the temper rolling reduction ratio of the range of the present invention, the crystal grains that recrystallized in the softening and annealing at 800° C. are a mixture of large and small grains, and the magnetostriction properties fall about $10\times10^{-6}$ in comparison to example 8, and the magnetic properties and Young's modulus after the blackening process are somewhat lowered. However, from the point of utility, this does not comprise a significant hindrance.

Because example 8c exceeds the upper limit of the temper rolling reduction ratio of the present invention, and the crystal grain size during recrystallizing in the softening and annealing at 800° C. became small and a mixture of sizes occurred easily, and thus the magnetostriction had a tendency to become more negative, and the Young's modulus and the magnetic properties had values that were lower than the original values (example 8).

As explained referring to FIG. 2, magnetostriction and permeability are mutually related properties. Therefore, like magnetic properties such as permeability, the magnetostriction is a property that is sensitive to the crystal grain size and the residual amount of distortion.

In addition, as is made clear from examples 8 and 8a to 8c, the magnetostriction greatly changes depending on the production conditions before softening and annealing, even for identical constituents, and as a result, the Young's modulus and the magnetic characteristics also fluctuate. In particular, depending on the temper rolling reduction ratio, the magnetostriction changes because the crystal grain size and the residual magnetostriction after the softening and annealing changes. Therefore, making the temper rolling reduction ratio 10 to 40% is important.

In this manner, the magnetostriction control type alloy sheet according to the examples of the present invention remarkably improves the permeability ($\mu_m$) and the Young's modulus (E) in comparison to the conventional 36 Ni—Fe invar alloy, and clearly the other characteristics are maintained at levels equivalent to those of the conventional product.

Although the invention has been described in detail herein with reference to its preferred embodiments and certain described alternatives, it is to be understood that this description is by way of example only, and it is not to be construed in a limiting sense. It is further understood that numerous changes in the details of the embodiments of the invention, and additional embodiments of the invention, will be apparent to, and may be made by, persons of ordinary skill in the art having reference to this description. It is contemplated that all such changes and additional embodiments are within the spirit and true scope of the invention as claimed.

What is claimed is:

1. A magnetostriction control alloy sheet, which may be used in a part of a color Braun tube such as a shadow mask, the magnetostriction $\lambda$ of the magnetostriction control alloy sheet after softening and annealing being between $-15\times10^{-6}$ and $+25\times10^{-6}$, and the {100}degree of accumulation on a rolled surface of the alloy sheet being 40 to 90%.

2. A part for a color Braun tube having a magnetostriction control alloy sheet, the magnetostriction control alloy sheet comprising a temper rolled Ni—Co—Fe alloy which contains C at 0.01 wt. % or less, Ni at 30 to 36 wt. %, Co at 1 to 5.0 wt. %, and Cr at 0.1 to 2 wt. %, and also contains at least one of Si at 0.001 to 0.10 wt. % and Mn at 0.001 to 1.0 wt. %, the remainder comprising Fe and unavoidable impurities; and the {100} degree of accumulation on the rolled surface of the alloy sheet being 40 to 90%.

3. A magnetostriction control alloy sheet being a temper rolled alloy sheet which may be used in a part for a color Braun tube such as a shadow mask, the magnetostriction $\lambda$ of the magnetostriction control alloy sheet after softening and annealing being between $-15\times10^{-6}$ and $+25\times10^{-6}$, and the {100} degree of accumulation on a rolled surface of the temper rolled alloy sheet being 40 to 90%.

4. A magnetostriction control alloy sheet according to claim 3 having a crystal grain size number of 8 to 12.

5. A color Braun tube comprising:

a cathode;

an anode; and a shadow mask including a magnetostriction control alloy sheet, the magnetostriction control alloy sheet comprising a Ni—Co—Fe alloy which contains C at 0.01 wt. % or less, Ni at 30 to 36 wt. %, Co at 1 to 5.0 wt. %, and Cr at 0.1 to 2 wt. %, and also contains at least one of Si at 0.001 to 0.10 wt. % and Mn at 0.001 to 1.0 wt. %, the remainder comprising Fe and unavoidable impurities, and the {100}degree of accumulation on a rolled surface of the magnetostriction control alloy sheet being 40 to 90%.

6. A color Braun tube comprising:

a cathode;

an anode; and a shadow mask including a magnetostriction control alloy sheet comprising a Ni—Co—Fe alloy which contains C at 0.01 wt. % or less, Ni at 30 to 36 wt. %, Co at 1 to 5.0 wt. % and Cr at 0.1 to 2 wt. %, and also contains at least one of Si at 0.001 to 0.10 wt. % and Mn at 0.001 to 1.0 wt. %, the remainder comprising Fe and unavoidable impurities, the magnetostriction $\lambda$ of the magnetostriction control alloy sheet after softening and annealing being between $-15\times10^{-6}$ and $+25\times10^{-6}$, and the {100} degree of accumulation on a rolled surface of the magnetostriction control alloy sheet being 40 to 90%.

7. A part for a color Braun tube having a magnetostriction control alloy sheet, the magnetostriction control alloy sheet comprising a Ni—Co—Fe alloy which contains C at 0.01 wt. % or less, Ni at 30 to 36 wt. %, Co at 1 to 5.0 wt. % and Cr at 0.1 to 2 wt. %, and also contains at least one of Si at 0.001 to 0.10 wt. % and Mn at 0.001 to 1.0 wt. %, the remainder comprising Fe and unavoidable impurities, the magnetostriction $\lambda$ of the magnetostriction control alloy sheet after softening and annealing being between $-15\times10^{-6}$ and $+25\times10^{-6}$, and the {100} degree of accumulation on a rolled surface of the magnetostriction control alloy sheet being 40 to 90%.

8. The part of claim 7, wherein the part includes at least one of a shadow mask and an inner seal.

* * * * *